US005243837A

United States Patent [19]

Radermacher et al.

[11] Patent Number: 5,243,837

[45] Date of Patent: Sep. 14, 1993

[54] SUBCOOLING SYSTEM FOR REFRIGERATION CYCLE

[75] Inventors: Reinhard Radermacher, Silver Spring; Dongsoo Jung, Ellicott City, both of Md.

[73] Assignee: The University of Maryland, College Park, Md.

[21] Appl. No.: 846,947

[22] Filed: Mar. 6, 1992

[51] Int. Cl.[5] ..... F25B 41/00

[52] U.S. Cl. ..... 62/513; 62/113

[58] Field of Search ..... 62/113, 513

[56] References Cited

U.S. PATENT DOCUMENTS 3,064,449 11/1962 Rigney ..... 62/513
3,952,533 4/1976 Johnston et al. ..... 62/513
4,259,848 4/1981 Voight ..... 62/513
4,359,879 11/1982 Wright ..... 62/513
4,621,501 11/1986 Tanaka ..... 62/513
4,936,113 6/1990 Nivens ..... 62/513

*Primary Examiner*—Ronald C. Capossela
*Attorney, Agent, or Firm*—Oblon, Spivak, McClelland, Maier & Neustadt

[57] ABSTRACT

An improved subcooling system for nonazeotropic working fluid leaving a condenser in a multi-compartment system passes the fluid leaving the condenser in heat exchange relationship with fluid evaporating within the evaporator. The heat exchange relationship can be effected by an internal subcooler in which the fluid leaving the condenser is directed through a conduit within the tube of a fin-tube evaporator, the conduit being of smaller dimension than the tube of the evaporator.

5 Claims, 2 Drawing Sheets

SUBCOOLING SYSTEM FOR REFRIGERATION CYCLE

The government of the United States may have rights in this patent pursuant to Government Contract EPA-G-R-817111-01-0.

BACKGROUND OF THE INVENTION

1. Field of the Invention

This invention pertains to an improved internal heat exchange system significantly reducing the energy consumption of refrigerator/freezer units that use nonazeotropic refrigerant mixtures as working fluids. Specifically, liquid refrigerant leaving the condenser of a multi-compartment refrigeration system is subcooled prior to entering the evaporator on the way to a compressor. The efficiency of subcooling is improved by placing the working fluid mixture in heat exchange relationship with the cold suction vapor on route from the evaporator to the compressor and in heat exchange relationship with the evaporating fluid in the evaporator over the length of the evaporator.

2. Background of the Prior Art

Conventional refrigerator/freezer units employ a single refrigeration cycle to cool both the refrigerator and freezer, which are maintained at sharply different temperatures. Such refrigeration systems typically include a condenser and a compressor, between which working fluid is circulated, the condenser and the evaporator being separated by at least one heat exchanger, and at least one evaporator. In certain systems, multiple heat exchangers and evaporators can be used.

To conserve energy, and improve efficiency of the system, it is conventional to subcool the working fluid leaving the condenser, prior to entering the expansion valve or other means for expanding the gas flow at the entry to the evaporator. U.S. Pat. No. 4,773,234, Kann, U.S. Pat. No. 4,577,468, Nunn et al and U.S. Pat. No. 4,285,205, Martin et al all disclose this type of subcooling, where the liquid leaving the condenser is passed in heat exchange with suction gas leaving the evaporator. A typical system, such as that described in Martin et al, is illustrated in FIG. 1. The working fluid leaving the condenser passes, at point 100, in heat exchange relationship with a suction gas exhibiting the evaporator 102. The location of the heat exchange is not critical, save that it lie between the condenser and expansion valve 104, or similar expansion means, immediately upstream of the evaporator.

Conventionally, working fluids for systems of this type employ a single refrigerant, such as R12. U.S. Pat. No. 4,781,738, Fujiwara et al, as well as others, employ nonazeotropic refrigerant mixture working fluids in systems of this type. In general, it is known that nonazeotropic mixtures can be used in multi-compartment refrigeration systems, that is, refrigeration systems wherein at least two compartments are maintained at separate temperatures.

Nonetheless, superior efficiencies in subcooling the working fluid leaving the condenser may be of value in improving the efficiency of systems of this type.

SUMMARY OF THE INVENTION

Improved efficiency in refrigeration cycles for multicompartment refrigeration apparatus can be achieved by employing improved subcooling of the working fluid flowing from the condenser to the evaporator, or evaporators. In addition to conventional subcooling by placing the working fluid leaving the condenser in heat exchange relationship with suction gas exiting the evaporator, improved subcooling can be achieved by directing the working fluid from the condenser into heat exchange relationship with the refrigerant mixture in the evaporator, by placing the conduits directing the two in heat exchange relationship. In a preferred embodiment, the working fluid leaving the condenser, after being placed in heat exchange relationship with the suction gas, enters the evaporator itself, through a conduit contained totally within the evaporator, at the upstream end of the evaporator, exiting at the downstream end of the evaporator immediately prior to the expansion valve which leads to the evaporator, per se. Substantial improvements in efficiency are obtained by this additional cooling.

In one embodiment using structures already available in the art, the evaporator is of conventional fin-tube design. The working fluid to be subcooled is contained within a pipe or conduit contained within the evaporator tube. Such a device can be conveniently made by inserting the conduit for carrying the fluid to be subcooled in the evaporator tube prior to bending the evaporator tube. Again, this tube enters the evaporator close to the compressor suction inlet, for heat exchange with the suction gas, and leaves just before the expansion valve.

DETAILED DESCRIPTION OF THE INVENTION

This invention, pertaining to the subcooling of working fluids flowing from the evaporator, can be used with all nonazeotropic refrigerant mixtures. Due to the gliding temperature interval between evaporation and condensation, improved performance is obtained. This gliding temperature interval makes it of benefit to subcool the liquid leaving the condenser by heat exchange with the evaporating fluid for the entire length of the evaporator in addition to the heat exchange with the suction gas, previously practiced in the prior art.

Figure 1:
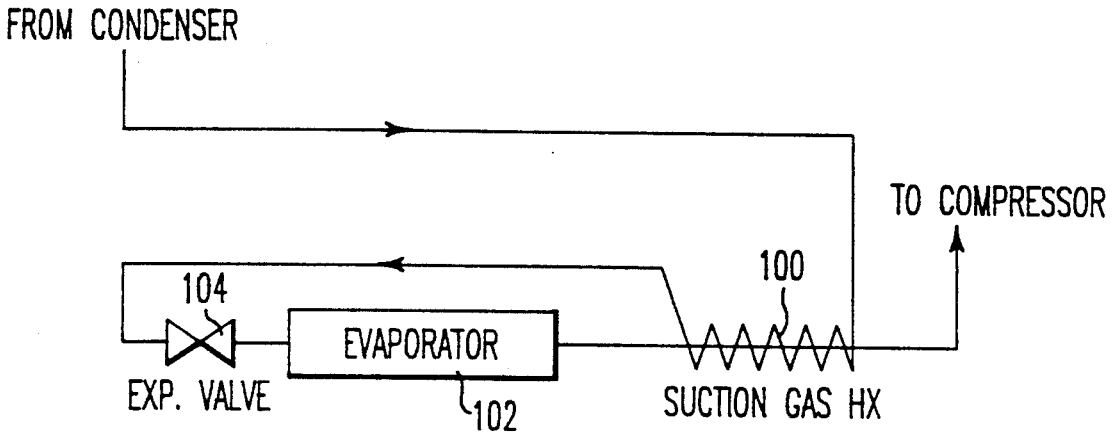
FIG. 1 PRIOR ART
FIG. 1 is schematic illustration of a subcooling cycle described in the prior art.
Figure 2:
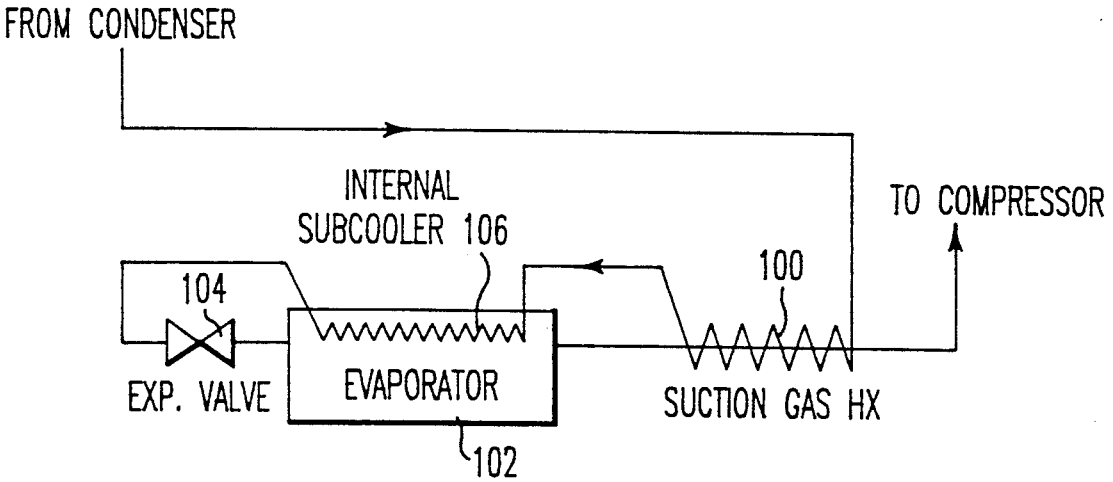
FIG. 2 is a schematic illustration of a subcooling cycle according to the invention, wherein the refrigeration cycle uses a single evaporator.

Referring to the Figures, where like numbers in separate drawings, indicate like parts, the invention is illustrated in its simplest form in FIG. 2. As with the prior art subcooling system illustrated in FIG. 1, the liquid flowing from the condenser passes in heat exchange relationship with the suction gas from the evaporator, close to the suction inlet for the compressor. In prior art systems, this process subcools the liquid, while preheating the suction vapor, leading to some loss of efficiency in the compression process. In this heat exchange relationship alone, the advantage of subcooling only barely outweighs the disadvantage of loss of efficiency in the compression process.

To improve the advantage obtained, in the claimed invention, the working fluid leaving the condenser is again subcooled in an internal subcooler 106, in heat exchange relationship with the evaporating fluid in the evaporator 102, preferably for the entire length of the evaporator. Again, the subcooler is upstream of the expansion valve 104 leading to evaporator 102.

Although many combinations of apparatus can be used to place the working fluid leaving the condenser in heat exchange relationship with the evaporating fluid in the evaporator, in a preferred embodiment, the evaporator is of convention fin-tube design. The evaporator tube contains within it a conduit of external dimensions smaller than the internal dimension of the evaporator tube. This smaller conduit carries the working fluid, and constitutes the internal subcooler. Such an apparatus can be easily prepared by inserting the conduit in the evaporator tube prior to bending the evaporator tube, as is conventional. This conduit enters the evaporator shortly after passing in heat exchange relationship with the suction gas, that is, close to the suction inlet for the compressor. The subcooler should exit the evaporator as late as possible, to maximize efficiency, but must exit prior to the expansion valve.

Figure 3:
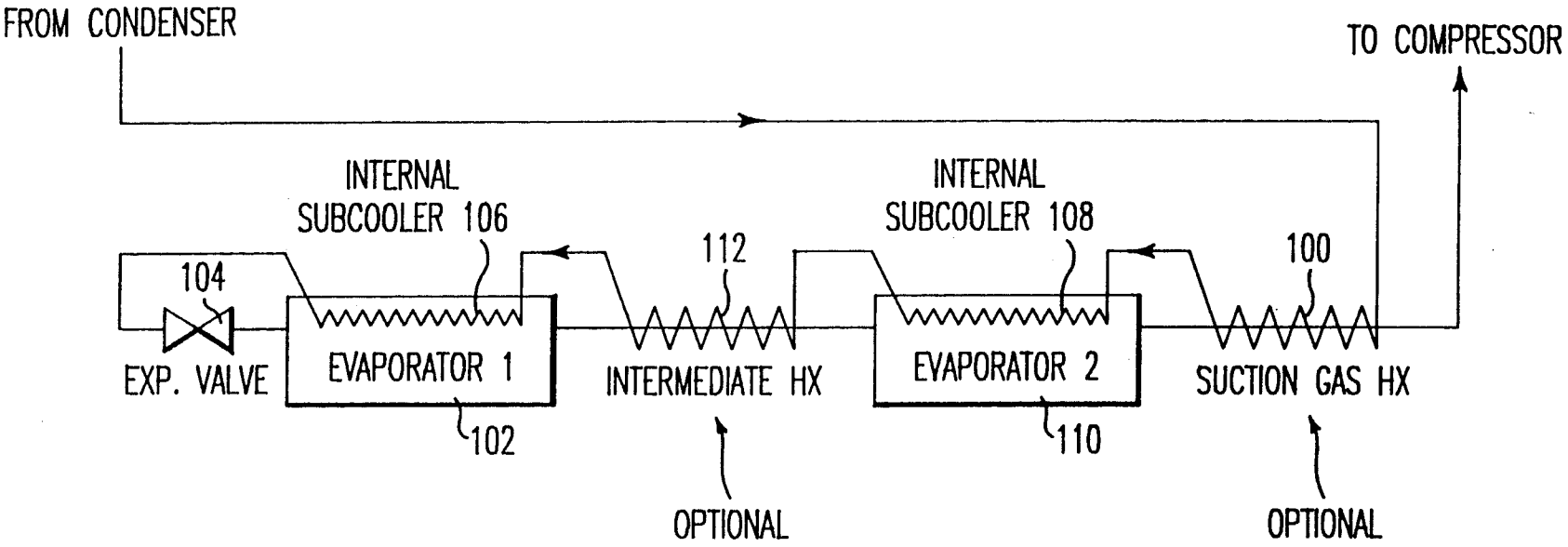
FIG. 3 is an illustration of a subcooling cycle according to the invention, wherein the refrigeration cycle employs two evaporators, and the working fluid flowing from the condenser is in heat exchange relationship with both evaporators.

A preferred embodiment of the invention is illustrated in FIG. 3. In this embodiment, the refrigeration cycle has two evaporators, both in line after the expansion valve, and between the condenser and the compressor. Such a system is described in U.S. Pat. No. 5,092,138, the entire disclosure of which is incorporated herein by reference. Improved subcooling can be obtained by placing the working fluid flowing from the condenser in heat exchange relationship with the evaporating fluid in both evaporators. Thus, in addition to the internal subcooler 106 in evaporator 102, a second internal subcooler 108 lies within second evaporator 110. The internal subcoolers may be of the same design, as described above, or of different configurations. The advantages secured by this dual subcooling are sufficiently great as to make heat exchange between the working fluid and the system exiting both evaporators optional. This includes the heat exchange 100, and heat exchange between the evaporators 112.

In the operation of the system FIG. 3, the vapor quality at the exit of the second evaporator 110 can be one, or less than one. The invention includes dual phase operations.

As noted, the system is designed to work with nonazeotropic working fluid mixtures, known to those of skill in the art. Advantages will be secured with virtually any nonazeotropic system. Prior art systems include mixtures of R12 and R11, and low and high boiling components combinations, such as those identified in U.S. Pat. Nos. 4,707,996 and 4,674,297. Particularly preferred working fluid mixtures include those described in U.S. Pat. No. 5,092,138, including combinations with R22, and complimentary components such as R123, **R141*b*, and R142*b*. Other combinations may be employed, such as R32 together with R142*b*, R124**, etc. Additional preferred embodiments include the environmentally safe working fluid mixtures set forth in patent application Ser. No. 07/846,917, by the inventors herein, filed contemporaneously herewith, the disclosure of which is incorporated herein by reference.

Obviously, numerous modification and variations of the present invention are possible in light of the above teachings. The refrigeration cycle may be expanded to include a variety of additional units, but all are ultimately based on the essential components of a condenser and compressor in fluid communication, with an expansion valve and at least one evaporator downstream of the condenser and prior to the compressor. The heat exchange relationship may be of any design, without departing from the invention, save as recited in the claims appended hereto. The nonazeotropic working fluid mixture of the invention is similarly susceptible to variation and alteration, without departing from the scope of the invention.

What is claimed is:

1. In a refrigeration system comprising a condenser and a compressor in fluid communication between which is situated an evaporator downstream of a means for expanding a nonazeotropic mixture refrigerant working fluid circulated within said system, the improvement comprising a subcooling system for subcooling working fluid leaving said condenser by directing said working fluid from said condenser to said expansion means through a fluid communication means in a first heat exchange relationship with a suction vapor leaving said evaporator and entering said compressor and a second heat exchange relationship with working fluid evaporating in said evaporator, said second heat exchange relationship being downstream of said first heat exchange relationship and upstream of said expansion means.

2. The system of claim 1, wherein said fluid to be subcooled is circulated through said evaporator in a conduit within said evaporator, said evaporator being of a fin-tube design, said conduit having an external diameter less than the internal diameter of the tube of said evaporator.

3. The system of claim 2, wherein said evaporator tube, and said conduit therewithin, are bent through at least one angle.

4. The system of claim 1, wherein said system comprises a second evaporator located between said evaporator and said compressor, and said fluid to be subcooled is in heat exchange relationship with fluid evaporating in said second evaporator.

5. The system of claim 4, wherein said fluid to be subcooled is in heat exchange relationship with working fluid passing between said evaporators and suction gas leaving said second evaporator.

* * * * *